United States Patent [19]

Brawn

[11] 3,972,326

[45] Aug. 3, 1976

[54] POSITIVE REINFORCEMENT RESPIRATORY INHALATION DEVICE

[76] Inventor: Peter Nelson Brawn, 36 Fairfield St., Pittsfield, Mass. 01020

[22] Filed: Jan. 21, 1975

[21] Appl. No.: 542,795

Related U.S. Application Data

[63] Continuation-in-part of Ser. No. 435,877, Jan. 23, 1974, abandoned.

[52] U.S. Cl. ..... 128/210; 128/208

[51] Int. Cl.[2] ..... A61M 16/00

[58] Field of Search ..... 128/210, 209, 196, 197, 128/265, 211, 186, 194, 185, 276, DIG. 10, 277, 193, 2.08, 204, 2 F, DIG. 5, 188, 199, 200, 275; 272/57 F; 261/69 R, DIG. 75; 215/11 B, 11 D

[56] References Cited

UNITED STATES PATENTS

| | | | |
|---|---|---|---|
| 2,136,844 | 11/1938 | Fair et al. | 128/197 |
| 2,342,602 | 2/1944 | Reitz, Jr. | 128/188 |
| 3,265,067 | 8/1966 | Ehlinger | 128/196 |

FOREIGN PATENTS OR APPLICATIONS

| | | | |
|---|---|---|---|
| 226,793 | 4/1943 | Switzerland | 128/210 |

*Primary Examiner*—Robert W. Michell
*Assistant Examiner*—Henry J. Recla
*Attorney, Agent, or Firm*—Finnegan, Henderson, Farabow & Garrett

[57] ABSTRACT

A positive reinforcement respiratory inhalation device is provided for respiratory therapy used primarily for postsurgical patients. The device also provides controlled ingestion of liquid. The respiratory inhalation device includes a container for holding liquid and a first tube projecting through the lid of the container which provides support for a second tube which fits snugly inside the first tube and extends into the container. The second tube has a plurality of openings at various heights in its wall which selectively can be occluded by moving it relative to the first tube. When the container is filled with liquid to a level above a first end of the second tube, the amount of inspiratory effort applied to the second end of the second tube which is required of a patient to withdraw a given amount of liquid from the container can be controlled by adjusting the second tube up or down within the first tube to occlude more or less openings. The more openings occluded, the less effort is required to withdraw a given amount of liquid.

12 Claims, 4 Drawing Figures

POSITIVE REINFORCEMENT RESPIRATORY INHALATION DEVICE

BACKGROUND OF THE INVENTION

This application is a continuation-in-part of Application Ser. No. 435,877 filed Jan. 23, 1974, and now abandoned.

This invention relates to a device used to respiratory therapy. Particularly, this device provides positive reinforcement to the patient to cause deep inhalation by rewarding him with a controlled intake of liquid.

Most hospitals in the United States have a 24-hour around the clock respiratory therapy department. Respiratory therapy is vitally important to the well-being of every patient in a hospital and particularly to patients during the post-operative period following surgery. The major emphasis of respiratory therapy is to encourage deep inhalation by the patient.

Following surgery patients experience great thirst because they are not allowed to take liquid orally. There is no oral intake of liquid for a period of two to three days following surgery because of gastro-intestinal motility secondary to the trauma of the surgery itself and the depressive effect of anesthesia. During this post-operative period, the patients are particularly susceptible to the quite common problem of post-operative atelectasis which is an incomplete expansion of the lung secondary to collapse of pulmonary alveoli.

SUMMARY OF THE INVENTION

The present invention provides a device which motivates the patient to inhale deeply. Considered in its broadest aspects, the positive reinforcement respiratory inhalation device allows the patient to quench his thirst while simultaneously undergoing respiratory therapy for atelectasis through deep breathing encouraged by use of this device. The amount of liquid taken in by the patient for a given inhalation effort is adjustably controlled by the doctor, nurse, or patient himself.

The positive reinforcement respiratory inhalation device of this invention is comprised of a container which holds liquid, a lid portion mounted on the container having an opening through which a first tube projects and which is fixedly attached to the lid, a second tube which slidably fits within the first tube and provides communicating access between the interior and exterior of the container, the second tube having a plurality of openings at varying heights in the well portion through whic air can be admitted, and which can be selectively occluded by the wall portion of the first tube by sliding the second tube up or down relative to the first tube. The effect of occluding or blocking holes in the second tube reduces the amount of air admitted through the openings to be mixed with the liquid as it is withdrawn from the container by the patient with a given inspiratory effort. Thus the amount of liquid withdrawn from the container for a given inspiratory effort by the patient can be controlled by the selective occlusion of the holes in the second tube.

The invention consists in the novel parts, constructions, arrangements, combinations and improvements shown and described. The accompanying drawings, which are incorporated in and constitute a part of the specification, illustrate one embodiment of the invention, and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
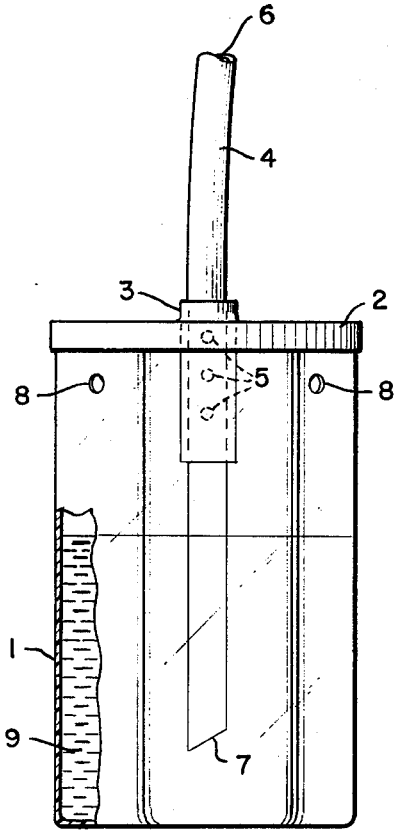
FIG. 1 is a schematic representation of a preferred embodiment of the present invention.
Figure 2:
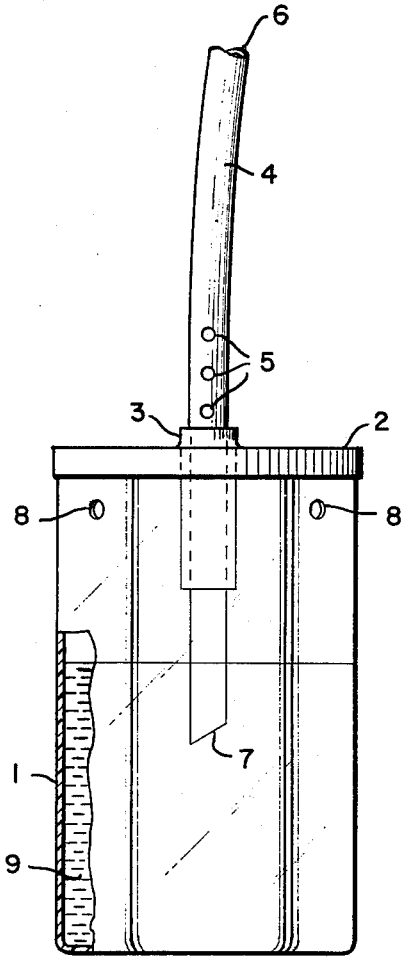
FIG. 2 is the same embodiment as shown in FIG. 1, adjusted to require greater inspiratory effort by the user to deliver the same amount of liquid from the device.

Referring now to FIGS. 1 and 2, a positive reinforcement respiratory inhalation device is shown. According to this invention, a container 1 which is made of a material such as plastic or glass, holds a liquid 9 such as water. It is preferred that the container 1 include a lid portion having an opening which communicates to the interior of the container 1. The lid portion 2 is conveniently mounted to container 1 in a removable yet air-tight manner such as by a simple frictionfit or by mating threads. The lid may also be permanently affixed to container 1 although such construction may not be as convenient for adding liquid to the container 1.

It is preferred that a first tube 3 project through the opening in the lid portion 2 such that the exterior perimeter wall of the tube 3 fits tightly within the hole and against its edges so as to be fixedly attached to the lid portion 2. Tube 3 being open at both ends, provides communicating access from the interior of container 1 to the exterior atmosphere.

It is further preferred that a second tube 4 whose outside circumference approximates the interior circumference of tube 3, be fitted within tube 3. The relationship between the first tube 3 and the second tube 4 should be such that tube 4 is held in position by the tightness of fit within tube 3, but can nevertheless be moved up or down therein by a small effort applied to it. Tube 4 is thereby slideably fitted within tube 3 to provide open communicating access between the interior and exterior of container 1.

Preferably, the first end of the second tube 4 projects below the surface of the liquid 9 and the second user end porjects exteriorly of the container 1, being adapted to be inserted into the mouth of the patient of user.

Tube 4 is provided with a plurality of openings 5 at varying heights in the wall which can be occluded or blocked by sliding tube 4 down within tube 3 as shown in FIG. 1. The holes 5 are opened to the exterior environment by sliding tube 4 up within tube 3 as shown in FIG. 2. Tube 4, if moved into an intermediate position between those positions shown in FIGS. 1 and 2, is adjusted to have selected holes 5 occluded and other holes opened to the exterior environment. Different gradients of air flow through the openings 5 are achieved by sliding the tube 4 to intermediate positions between those shown in FIGS. 1 and 2.

As here embodied tube 4 has a first end 7 which projects below the surface of the liquid 9 contained in container 1. Liquid can only be withdrawn from the container when tube 4 is below the surface of the liquid 9. The second end 6 of tube 4 is for use by the patient or user. An inspiratory effort or sucking action by the user applied to the end 6 of tube 4 causes liquid to rise in tube 4 and to be withdrawn from container 1. The inspiratory effort required for a given amount of liquid withdrawal is controlled by the number of openings 5 which communicate air pressure effects to the interior of tube 4.

Preferably the amount of inspiratory effort or reduced pressure at the end 6 required to deliver liquid from the container 1 is adjusted by selectively occluding the openings 5 in tube 4 by the wall portion of tube 3.

Additional openings 8 are provided as shown in the FIGS. 1 and 2 around the upper perimeter of container 1. Such openings can as well be placed in the lid portion 2 of container 1. These openings 8 provide a controlled amount of atmospheric communication between the interior and exterior of container 1, even when lid 2 is fixedly attached to container 1.

In its preferred operation, the positive reinforcement respiratory inhalation device of FIGS. 1 and 2 rewards the user for a large inspiratory effort by delivering liquid to him. The more openings 5 open to the atmosphere the larger the impeding effect on the withdrawal of liquid for a given inspiratory effort. Thus, to deliver a given amount of liquid from the interior of container 1 to the end 6 of tube 4 requires a greater inspiratory effort when more openings 5 in tube 4 are not occluded by the wall of tube 3. In this manner, the device acts as a positive incentive for deep breathing, receipt of the liquid being the reward and positive reinforcement for deep breathing by the user.

Figure 3:
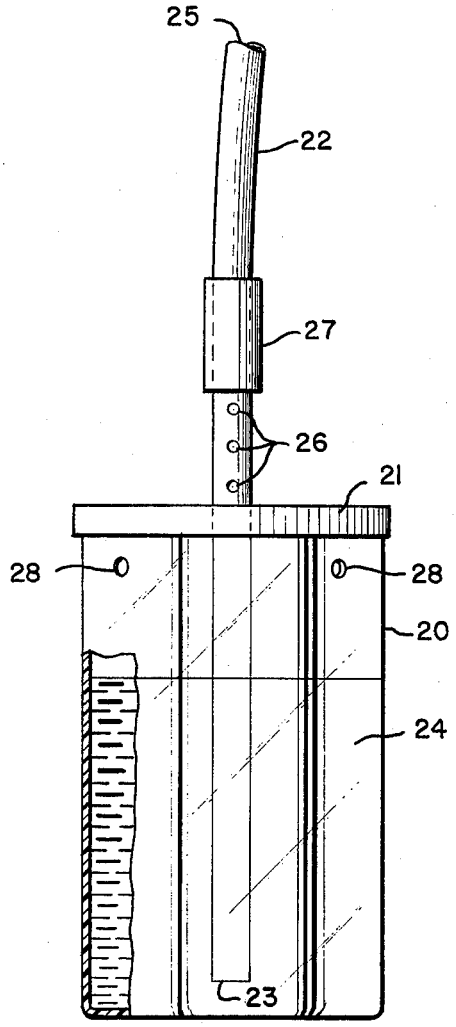
FIG. 3 is a schematic representation of another preferred embodiment of the present invention.

In accordance with this invention and as shown in FIG. 3, the positive reinforcement respiratory inhalation device can be modified to eliminate the potential problem of a dead space in the container below the end of the tube. Briefly referring to FIGS. 1 and 2 again, it is readily seen that as tube 4 is drawn up through tube 3 to open additional holes 5 to the atmosphere, the end 7 is raised in the container 1. Thus, when tube 4 is raised as shown in FIG. 2, there is a larger volume of liquid 9 below end 7 which potentially cannot be withdrawn. If the end 7 is withdrawn from the liquid 9, the device becomes inoperative, a substantial amount of liquid 9 can remain in the container 1 and yet end 8 will be above the surface of the liquid 9 thereby rendering the device inoperative.

The embodiment of this invention, shown in FIG. 3, overcomes the above problem. In accordance with the invention as shown in FIG. 3, the container 20 has a lid portion 21 having an opening through which a tube can be inserted into the interior of container 20. The lid portion 21 is conveniently mounted to container 20 in a removable yet air tight manner such as by a simple friction fit or by mating threads. It will be understood that the lid portion 21 may also be permanently affixed to the container 20; however, such construction may prove inconvenient for adding liquid to the container 20.

In accordance with this invention a first tube 22 having a first end 23 adapted to project into the liquid 24 passes through the above mentioned hole in lid 21. The second end 25 of tube 22 which is exterior to container 20 is adapted to be inserted into the mouth of a user or patient.

It is preferred that tube 22 fit tightly through the hole in lid portion 21 in a manner such that the exterior perimeter wall portion of tube 22 can be fixedly attached to lid portion 21. Tube 22 thereby provides open communicating access between the interior and exterior of container 20.

Tube 22 further has a plurality of openings 26 disposed at varying heights in the wall portion of tube 22 through which air may be admitted.

Preferably a second tube 27 is slideably fitted over the first tube 22. Tube 27 is adjustable up or down in a slideable fashion on tube 22. Preferably tube 27 is sufficiently long to span all holes 26 in the wall portion of tube 22 when in a lowered position and thereby occlude all holes when in that position.

Preferably the openings 26 can be selectively occluded by the wall portion of tube 27 by moving tube 27 up or down to selected heights relative to the first tube 22. When an inspiratory effort is applied at the second end 25 of tube 22 by the user or patient, the liquid is drawn from the container and mixed with small amounts of air admitted through the openings 26 which are not occluded.

When the positive reinforcement respiratory inhalation device of FIG. 3 is used by a patient, the tube 22 is maintained stationary relative to the container 20 and the amount of liquid withdrawn from the container 20 can be varied by moving only the tube 27. Thus, the end 23 of tube 22 is at a constant level close to the bottom of container 20. Substantially all the liquid 24 in container 20 can be removed from the container by the proper inspiratory effort applied to end 25 of tube 22.

Again referring to FIG. 3, the container 20 has one or more openings 28 located in the upper wall portion of the container. These openings 28 communicate the atmospheric pressure to the interior of container 20 and to the surface of liquid 24. It will readily be apparent that such holes 28 can also be placed in the lid portion 21 for similar results.

Figure 4:
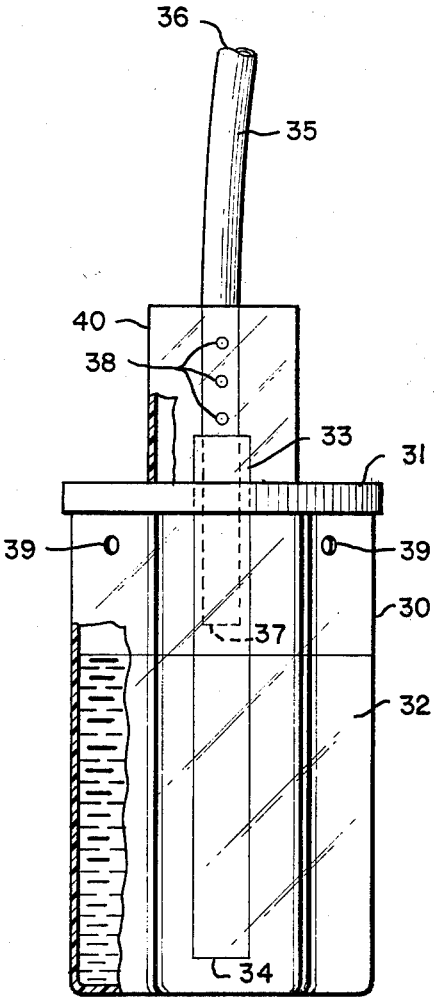
FIG. 4 is a schematic representation of yet another preferred embodiment of the present invention.

In FIG. 4, an additional embodiment of the positive reinforcement respiratory inhalation device is shown. In accordance with the invention as shown in FIG. 4, a container 30, having a lid portion 31, contains liquid 32. The lid portion 31 has an opening through which a tube can be inserted into the interior of container 30. The lid portion 31 is conveniently mounted to container 30 in a removable yet air-tight manner such as by a simple friction fit or by mating threads. It will be understood as in previous embodiments that the lid portion 31 may also be permanently affixed to container 30. However such a construction may be less convenient for purposes of adding additional liquid to the container 30.

Preferably a first tube 33 passes through the above mentioned hole in the lid portion 31 such that its exterior perimeter wall portion can be fixedly attached and sealed to lid 31. The tube 33 projects downward into the liquid 32 so that end 34 is located well below the surface of the liquid 32 near the bottom of container 30.

In accordance with this invention a second tube 35 is slideably fitted within the first tube 33 by a close frictional fit. One end 36 of tube 35 is adapted to be inserted into the mouth of a user. The second end is fitted within the first tube 33 in a manner such that the combined tubes 33 and 35 provide open communicating access between the interior and exterior of container 30.

It is preferred that tube 35 have a plurality of openings located at varying heights in the wall portion of the tube 35 through which air may be admitted. Thus, upon application of an inspiratory effort by the use to end 36 of tube 35, liquid will be withdrawn from container 30 through end 34 of tube 35 and mixed with air admitted through openings 38.

The openings 38 can be selectively occluded by the wall portion of tube 33 by moving tube 35 downward relative to tube 33. As tube 35 is moved downward to selected heights relative to fixed tube 33, additional openings 38 can be occluded by tube 33. As shown in FIG. 4, all openings 38 are open and a maximum inspiratory effort is required at end 36 of tube 35 to withdraw a given amount of liquid 32 from container 30. The inspiratory effort required to withdraw liquid from container 30 is reduced by sliding tube 35 downward into tube 33 so as to block or occlude additional openings 38. Thus the liquid 32, when inspiratory effort is applied at end 36 of tube 35 is withdrawn in varying volumes depending upon the number of openings 38 occluded by tube 33.

It is preferred to have openings 39 in the upper wall portion of container 30. Such openings 39 communicate the exterior atmospheric pressure to the interior of container 30 and to the surface of liquid 32. It will be understood that similar openings could be located on lid portion 31 with the same resultant effect.

With reference to FIG. 4 it is further preferred that shielding means be provided to block spray which may emanate from openings 38 in tube 35. As here embodied such means are shown as the shielding tubing 40. The shielding tubing preferably is affixed to lid 31 in a manner to surround the tubes 33 and 35 and more particularly to encompass that portion of tube 35 in which the holes 38 are located. Thus when inspiratory effort is applied by the user to end 37 of tube 35, even with all the openings 38 open, the spray from the openings 38 will be blocked by the shielding tube 40.

One modification of the device of FIG. 4 which allows the walls of container 30 and the lid portion 31 to act as a shield is to place the openings 38 in the first tube 33 instead of in the second tube 35. If these openings are in the portion of the tube 33 above the surface of the liquid 32 but below the lid portion 31, no spray will be able to escape from the container 30. The tube 35 then is moved up or down to open or occlude the openings 38.

It is well to understand that the embodiments of FIGS. 3 and 4 can be slightly modified by removing the lid portions, 21 and 31 respectively, and yet still function as a positive reinforcement respiratory inhalation device. In both cases when the first and second tubes, fitted together as shown in the respective figures, are used in a manner like an ordinary drinking straw by the patient.

Finally, in each embodiment of the positive reinforcement respiratory device it should be clear that the user draws the air and liquid into his oral cavity (mouth) but of course does not take liquid into his lungs. The air is drawn into the lungs, providing the respiratory therapy, and the liquid is subsequently swallowed by the patient.

What is claimed is:

1. A positive reinforcement respiratory inhalation device, including provision for controlled ingestion of liquid into the mouth of a user, comprising in combination:

a container for holding said liquid having at least one opening in a wall portion thereof which communicates exterior atmospheric pressure to the interior of said container;

said container including a lid portion;

a first tube projecting though said lid portion and having an exterior perimeter wall portion fixedly attached to said lid portion;

a second tube having a first end projecting into said container to a depth adjacent the bottom of said container and a second end exterior to the container adapted to be inserted into the mouth of said user, said second tube being slideably fitted within said first tube for providing open communicating access between the interior and exterior of said container;

said second tube having a plurality of openings at longitudinally spaced intervals in the wall portion of said second tube slideably received by said first tube through which air may be admitted;

whereby said openings being so spaced longitudinally of said second tube are sequentially and cumulatively occluded by the wall portion of said first tube when said second tube is moved in a given direction to selected heights relative to said first tube so that when said container holds liquid and inspiratory effort is applied at the second end of said second tube varying volumes of liquid are withdrawn dependent upon the number of openings occluded by said wall portion.

2. The positive reinforcement respiratory inhalation device of claim 1 wherein said at least one opening is in said lid portion.

3. The positive reinforcement respiratory inhalation device of claim 1 wherein said container is made of plastic.

4. The positive reinforcement respiratory inhalation device of claim 1 further including shielding means attached to said lid portion and surrounding said second tube to block spray from said openings of said second tube when inspiratory effort is applied to said user end.

5. A positive reinforcement respiratory inhalation device, including provision for controlled ingestion of liquid into the mouth of a user, comprising in combination:

a container for holding said liquid having at least one opening in a wall portion thereof which communicates exterior atmospheric pressure to the interior of said container;

said container including a lid portion;

a first tube having a first end projecting into said container to a depth adajcent the bottom of said container and a second end exterior to the container adapted to be inserted into the mouth of said user, said first tube projecting through and having an exterior perimeter wall portion fixedly attached to said lid portion and providing open communicating access between the interior and exterior of said container;

said first tube having a plurality of openings at spaced intervals in the wall portion of said first tube above said lid portion through which air may be admitted;

a second tube slideably fitted over said first tube and over said openings and adjustable up an down on said first tube; and said openings being so spaced longitudinally of said first tube to be sequentially and cumulatively occluded by the wall portion of said second tube when said second tube is moved in a given direction to selected heights relative to said first tube so that when said container holds liquid and inspiratory effort is applied at the second end of said second tube varying volumes of liquid are withdrawn dependent upon the number of openings occluded by said wall portion of said second tube.

6. The positive reinforcement respiratory inhalation device of claim 5 wherein said lid has at least on opening is in said lid portion.

7. A positive reinforcement respiratory inhalation device, including provision for controlled ingestion of liquid into the mouth of a user, comprising in combination:

a container for holding said liquid having at least one opening in a wall portion thereof which communicates exterior atmospheric pressure to the interior of said container;

said container including a lid portion;

a first tube passing through said lid portion and having an exterior perimeter wall portion fixedly attached to said lid portion, said first tube being projecting into said container to a depth adjacent the bottom of said container;

a second tube having a user end exterior to the container adapted to be inserted into the mouth of said user and a second end being slideably fitted within said first tube so constructed and arranged that said first and second tubes provide open communicating access between the interior and exterior of said container;

said second tube having a plurality of openings at spaced intervals in the wall portion of said second tube slidably received by said first tube through which ari may be admiteed; and said openings being so spaced longitudinally of said second tube to be sequentially and cumulatively occluded by the wall portion of said first tube when said second tube is moved in a given direction to selected heights relative to said first tube so that when said container holds liquid and inspiratory effort is applied at the second end of said second tube varying volumes of liquid are withdrawn dependent upon the number of openings occluded by the wall portion of said first tube.

8. The positive reinforcement respiratory inhalation device of claim 7 wherein said at least one opening is in said container's upper wall portion.

9. The positive reinforcement respiratory inhalation device of claim 8 further including shielding means attached to said lid and surrounding said second tube to block spray from said openings of said second tube when inspiratory effort is applied to said user end.

10. The positive reinforcement respiratory inhalation device of claim 9 wherein said shielding means is a shielding tube portion.

11. The positive reinforcement respiratory inhalation devie of claim 7 wherein said container is made of plastic.

12. The positive reinforcement respiratory inhalation device of claim 7 wherein said at least one opening is in said lid portion.

* * * * *

UNITED STATES PATENT OFFICE

CERTIFICATE OF CORRECTION

Patent No. 3972326 Dated August 3, 1976

Inventor(s) Peter Nelson Brawn

It is certified that error appears in the above-identified patent and that said Letters Patent are hereby corrected as shown below:

IN THE SPECIFICATIONS:

Column 1, line 9, change "to" to --in--

Column 1, line 51, change "whic" to --which--

Column 2, line 28, change "frictionfit" to --friction fit--

Column 2, line 52, change "porjects" to --projects--

Column 2, line 53, change "of", second occurrence, to -- or --.

Column 5, line 6. change "use" to --user--

Column 5, line 39, change "37" to --36--

IN THE CLAIMS:

Claim 6, column 7, line 13, change "on" to --one--

Claim 7, column 8, line 6, change "ari" to --air--

Claim 7, column 8, line 6, change "admiteed" to--admitted--

Claim 11, column 8, line 29, change "devie" to --device--

Signed and Sealed this

Fourteenth Day of December 1976

[SEAL]

*Attest:*

RUTH C. MASON
*Attesting Officer*

C. MARSHALL DANN
*Commissioner of Patents and Trademarks*